US006733367B1

(12) United States Patent
Nguyen

(10) Patent No.: US 6,733,367 B1
(45) Date of Patent: May 11, 2004

(54) METHOD AND APPARATUS FOR POLISHING SILICON WAFERS

(76) Inventor: Phuong Van Nguyen, 2903 Erica Ct., San Jose, CA (US) 95121

( * ) Notice: Subject to any disclaimer, the term of this patent is extended or adjusted under 35 U.S.C. 154(b) by 131 days.

(21) Appl. No.: 10/052,647

(22) Filed: Jan. 18, 2002

Related U.S. Application Data

(63) Continuation-in-part of application No. 09/962,897, filed on Sep. 25, 2001, now Pat. No. 6,645,049, and a continuation-in-part of application No. 09/908,013, filed on Jul. 18, 2001, and a continuation-in-part of application No. 09/840,506, filed on Apr. 23, 2001, now Pat. No. 6,612,095.

(51) Int. Cl.[7] ..... B24B 1/00

(52) U.S. Cl. ..... 451/29; 451/28; 451/41; 451/60; 451/285; 451/286; 451/287; 451/289; 451/490

(58) Field of Search ..... 451/28, 29, 41, 451/60, 285, 286, 287, 289, 490

(56) References Cited

U.S. PATENT DOCUMENTS 4,962,618 A * 10/1990 Wylde ..... 451/527
5,573,448 A * 11/1996 Nakazima et al. ..... 451/41
5,788,560 A * 8/1998 Hashimoto et al. ..... 451/288

* cited by examiner

*Primary Examiner*—Joseph J. Hail, III
*Assistant Examiner*—Shantese McDonald
(74) *Attorney, Agent, or Firm*—Michael I Kroll

(57) ABSTRACT

The invention shows a workpiece template and a number of additional elements for forming wafers of varying thicknesses=. The template is formed of a main disk including a plurality of cavities extending through a main plate with either a frictionless material or a backing plate forming the cavity base. The template shows additional elements to aid in the lapping/polishing abrasive fluid movement in the form of spiraling channels moving across the top surface of the template. The channels can extend through the template cavity walls. Also shown are the improvement previously stated applied to a template having notched gear-like teeth for another type of lapping/polishing machine.

19 Claims, 16 Drawing Sheets

METHOD AND APPARATUS FOR POLISHING SILICON WAFERS

REFERENCES TO RELATED APPLICATIONS

This application is a continuation-in-part application of United States patent applications:

a. Ser. No. 09/840,506 filed Apr. 23, 2001 and U.S. Pat. No. 6,612,095 b. Ser. No. 09/908,013 filed Jul. 18, 2001 and c. Ser. No. 09/962,897 filed Sep. 25, 2001 U.S. Pat. No. 6,645,049

BACKGROUND OF THE INVENTION

1. Field of the Invention

The present invention relates generally to workpiece templates and, more specifically, to workpiece templates used in lapping and polishing silicon wafers in either single or double sided polishing machines. The present invention is a template having a plurality of cavities within the body of the surface for inserting objects such as silicon wafers intended for lapping and polishing to a thickness equal to the depth of the template cavity.

In addition, the thickness of the intended object can be varied by inserting one or more shims into the workpiece cavity.

2. Description of the Prior Art

There are templates for lapping and polishing wafers to a desirable thickness determined by the depth of the template cavity. It has been found by the inventor that they contain one or more undesirable characteristics that render them unsuitable for repeated use.

The process of lapping and polishing wafers on a single side involves placing the workpiece or workpieces into a template and placing the template upside down between a rotating pneumatic head and a table having a controlled flow of abrasive slurry flowing onto the table surface during the pneumatic head rotation whereby the wafer blanks will be honed and polished to the thickness of the template.

There are a number of undesirable side effects that can occur in the prior art. As the wafers approach the thickness of the template cavity, the amount of fluid between the template and the lapping/polishing surface decreases causing spotted changes in the surface temperature of the template burnishing the template.

Another undesirable effect of this method relates to the cross sectional thickness of the, finished wafer. The wafers can rotate within the cavity causing the wafers to continuously butt up against the wall of the cavity and rise from the cavity base whereby the edge thickness can vary from the center thickness. This is especially undesirable in applications where tolerances are measure in microns.

An object of the present invention is to overcome these shortcomings within the prior art. The present invention also addresses another shortcoming within the prior art relating to the inordinate number of templates used because of the varied thicknesses required within the end product. The present invention addresses this need through the use of shims which can have a thickness imprinted on the shim or can be classified using a color code to indicate thickness. These shims can be permanently fixed to the workpiece cavity base having indicia indicating the thickness of the end product or a color code scheme can be used to indicate the thickness of the end product. In addition one or more shims could be removably inserted into one or more cavities to vary the thickness of the finished end product.

In addition the present invention addresses another shortcoming within the prior art related to lapping and polishing of non-standard shapes such as triangles, squares, rectangles, etc. The present invention overcomes the need for creating full sized templates for the aforementioned non-standard shapes by having smaller templates having cavities conforming to the desired non-standard shapes that are of substantially equal diameter to the cavities of the larger templates, thereby enabling lapping and/or polishing of silicon wafers of a non-standard size which also provides for the lapping and polishing of mixed wafer shapes by the selection and placements of smaller templates having the preselected shape or shapes placed within one or more cavities of the larger workpiece template.

Another additional element is provided for by the present invention in the form of channels etched into the top surface of the workpiece template for the purpose of channeling the abrasive and/or polishing fluid across the surface of the workpiece template during a lapping and/or polishing operation. Again returning to the problem of workpiece template burnishing due in some part to the lack of fluid between the workpiece template and the lapping/polishing surface, the present invention channels the lapping/polishing fluid across the entire surface of the workpiece template. Furthermore, the channels also serve to reduce hydrodynamic forces between the template and lapping/polishing operational surface caused by the rotational speed of the head, the lapping/polishing surface and the fluid therebetween by limiting the planar surface area between points of fluid transition which is currently the peripheral edge of the template.

Basically, the channels provide an abundance of fluid across the non-channeled planar surface by providing channels where fluid can be transferred from or to depending on the dynamic fluid forces at any point on the non-channeled planar surface.

Therefore, because of the aforementioned problems and shortcomings of the prior art it is felt that a need exists for the present invention and while the prior art may be suitable for the purposes for which they were designed, they would not be as suitable for the purposes of the present invention, as hereinafter described.

SUMMARY OF THE PRESENT INVENTION

A primary object of the present invention is to provide a workpiece template for lapping and/or polishing silicon wafers.

Another object of the present invention is to provide a lapping/polishing workpiece template that can be repeatedly reused.

Yet another object of the present invention is to provide a lapping and polishing workpiece template having a main plate with at least one cavity therethrough for the placement of a workpiece, such as a silicon wafer, to be lapped and/or polished.

Still yet another object of the present invention is to provide a lapping/polishing workpiece template comprised of a main plate having a substantially smoothed edged circular configuration.

A further object of the present invention is to provide a lapping/polishing workpiece template having a main plate having an additional element in the form of a circumferentially notched gear-like periphery.

A yet further object of the present invention is to provide a lapping/polishing workpiece template having a main plate having a top surface and a bottom surface having a further additional element in the form of channels having a channel base and opposing channel walls placed within the top surface extending from a substantially central position to the periphery of said workpiece template.

A still yet further object of the present invention is to provide a lapping/polishing workpiece template substantially comprised of fiberglass-epoxy laminates.

Another object of the present invention is to provide a lapping/polishing workpiece template having a main plate comprising a fiberglass-epoxy laminate and having a frictionless material fixedly positioned to the bottom surface of the main plate.

Yet another object of the present invention is to provide a lapping and polishing workpiece template having a main plate comprising a fiberglass-epoxy laminate and having a Mylar backing adhesively affixed thereto.

Still yet another object of the present invention is to provide a lapping/polishing workpiece template having a main plate comprising a fiberglass-epoxy laminate and having a frictionless material fixedly positioned to the bottom surface of the main plate forming a frictionless work holder cavity base.

A further object of the present invention is to provide a lapping/polishing workpiece template having a main plate and a further additional element in the form of a backing plate being of substantially equal diameter affixed thereto.

A yet further object of the present invention is to provide a lapping/polishing workpiece template having a main plate, a backing plate with a top side and a bottom side with said top side fixedly positioned to said main plate and said bottom side having an adhesive layer.

A still yet further object of the present invention is to provide a lapping/polishing workpiece template having a main plate, a backing plate with a top side and a bottom side with said top side fixedly positioned to said main plate and said bottom side having an adhesive layer with a peelable removable covering thereon.

Another object of the present invention is to provide a lapping and polishing workpiece template having a main plate and a backing plate affixed thereto having at least one cavity positioned within said main plate.

Yet another object of the present invention is to provide a lapping/polishing workpiece template having a main plate comprising a fiberglass-epoxy laminate having a mylar backing adhesively affixed thereto whereby said mylar or other suitable frictionless material will cause the at least one wafer to rotate.

Still yet another object of the present invention is to provide a template cavity unit that will circumferentially conform to the workpiece template cavity whereby said template cavity unit can be inserted into the workpiece template cavity.

A further object of the present invention is to provide a template cavity unit having one or more cavities therein for inserting workpieces intended for lapping/polishing.

A yet further object of the present invention is to provide a plurality of shims for placement into the cavity or cavities of the workpiece template.

A still yet further of the present invention is to provide a lapping/polishing workpiece template having a shim that can be removably inserted into each of the plurality of cavities within said template.

Another object of the present invention is to provide a lapping/polishing workpiece template having a plurality of shims of varying thicknesses that can be removably inserted into each of the plurality of cavities within said template.

Yet another object of the present invention is to provide a lapping/polishing workpiece template having a shim or shims affixed to the base of the plurality of cavities within said template.

Still yet another object of the present invention is to provide a lapping/polishing workpiece template having an affixed shim or shims of smaller diameter than the diameter of the workpiece cavity diameter of the plurality of workpiece cavities within said template.

A further object of the present invention is to provide a lapping/polishing workpiece template having an affixed shim of smaller diameter than the diameter of the workpiece cavity diameter of the plurality of workpiece cavities within said template whereby the periphery of the wafer inserted therein will extend beyond the circumference of said shim.

A yet further object of the present invention is to provide a lapping/polishing workpiece template having a shim of smaller diameter than the diameter of the workpiece cavity diameter whereby the periphery of the wafer contained therein will extend beyond the circumference of said shim to reduce tapering of said wafer.

A still yet further object of the present invention is to provide a lapping/polishing workpiece template having a plurality of shims manufactured from a suitable material such as polyurethane.

Another object of the present invention is to provide a lapping and polishing workpiece template having a plurality of shims color coded for various thicknesses that can be removably inserted into each of the plurality of cavities within said template whereby said template can be used to produce wafers of various thicknesses.

Yet another object of the present invention is to provide a lapping and polishing workpiece template wherein a plurality of color coded shims representative of various thicknesses can be inserted into one or more of the workpiece cavities to produce wafers of a calculated thickness equal to the total workpiece template cavity thickness minus the total of the shim or shims inserted therein.

Additional objects of the present invention will appear as the description proceeds.

The present invention overcomes the shortcomings of the prior art by providing a method and device whereby employing the reusable workpiece template and selectively inserting shims having means for identifying various thicknesses, will produce semiconductor wafers of varying thicknesses.

In addition, the workpiece template having one or more cavities with a shim centrally positioned therein and being of smaller diameter than the cavity base will reduce tapering of the wafer. Additionally, the shims manufactured from a suitable frictionless material, such as mylar, will induce rotation of the wafer further reducing tapering of said wafers.

Furthermore the workpiece template having channels formed therein provides means for the lapping/polishing material to circulate across the planar surface of the workpiece template eliminating burnishing of the template and unwanted hydrodynamic properties of the lapping/polishing material associated with a fluid compressed between the two planar surfaces of the workpiece template and the lapping/polishing surface.

The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

LIST OF REFERENCE NUMERALS UTILIZED IN THE DRAWINGS

10 workpiece holder
12 lapping/polishing machine
14 lapping/polishing surface
16 supply of abrasive material
18 abrasive material
20 rotating heads
22 main plate
24 main plate cavity
26 top surface of main plate
28 bottom surface of main plate
30 main plate exterior wall
32 workpiece template cavity wall
34 workpiece template cavity base
36 frictionless material
38 adhesive layer
40 removable protective layer
42 gear-like notches
44 workpiece surface channel
46 channel base
48 channel wall
50 backing plate
52 backing plate top surface
54 backing plate bottom surface
56 template cavity unit
58 template cavity unit exterior wall
60 template cavity unit top surface
62 template cavity unit bottom surface
64 template cavity unit cavity
66 shim

BRIEF DESCRIPTION OF THE DRAWING FIGURES

In order that the invention may be more fully understood, it will now be described, by way of example, with reference to the accompanying drawing in which.

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

Figure 1:
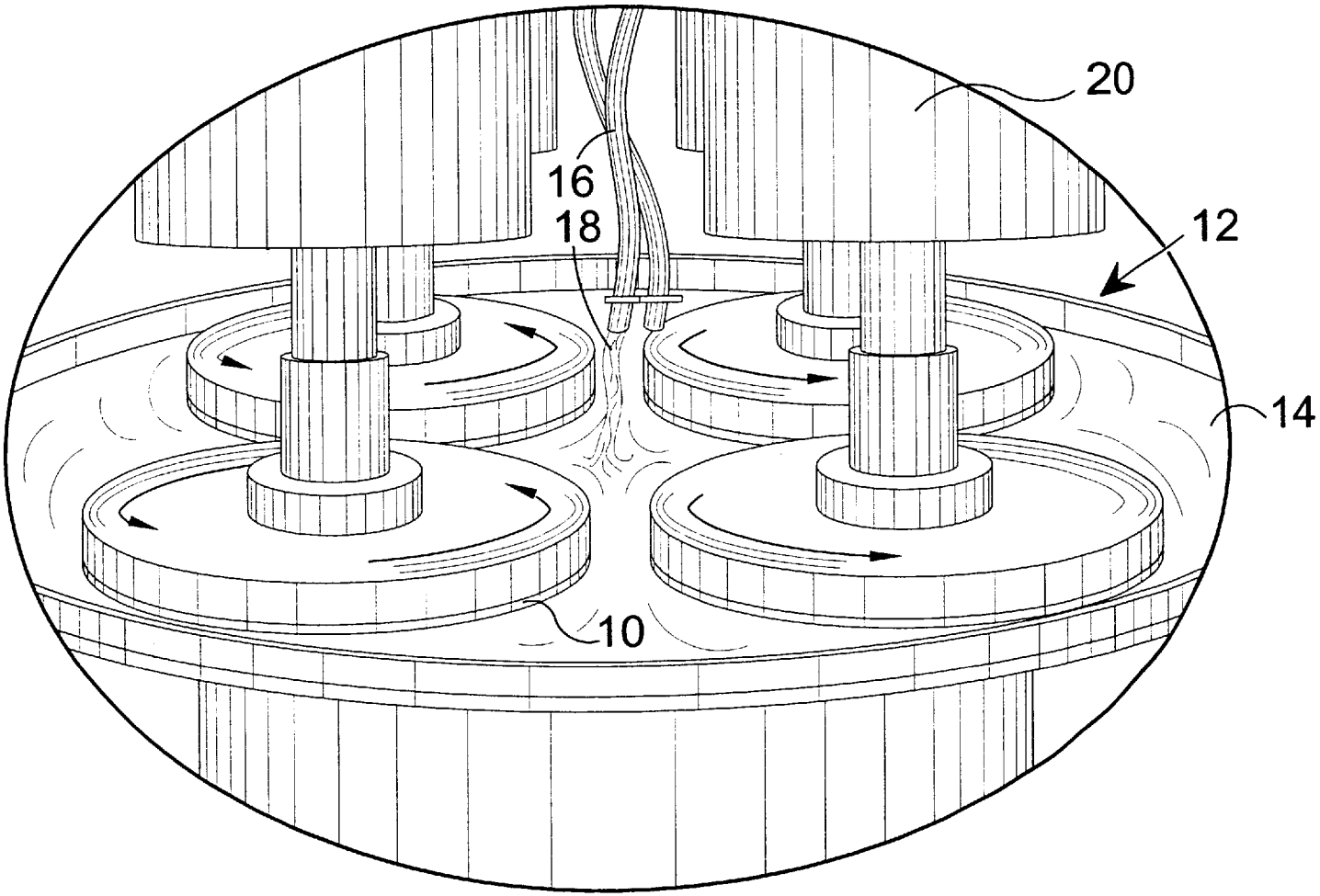
FIG. 1 is a perspective view of the present invention in use.

FIG. 1 is a perspective view of the present invention 10 in use on a lapping/polishing machine 12. The machine 12 has a lapping/polishing surface 14 having a delivery system 16 providing a constant supply of lapping/polishing material 18 deposited on the planar worksurface 14 of the lapping/polishing machine 12. The lapping/polishing workpiece template 10 of the present invention has a plurality of silicon wafers, not shown in this figure, positioned within the workpiece template 10. The lapping/polishing machine has a plurality of rotating heads 20 having the workpiece template 10 positioned thereunder causing the workpiece template to rotate while engaging the lapping/polishing surface 14.

Figure 2:
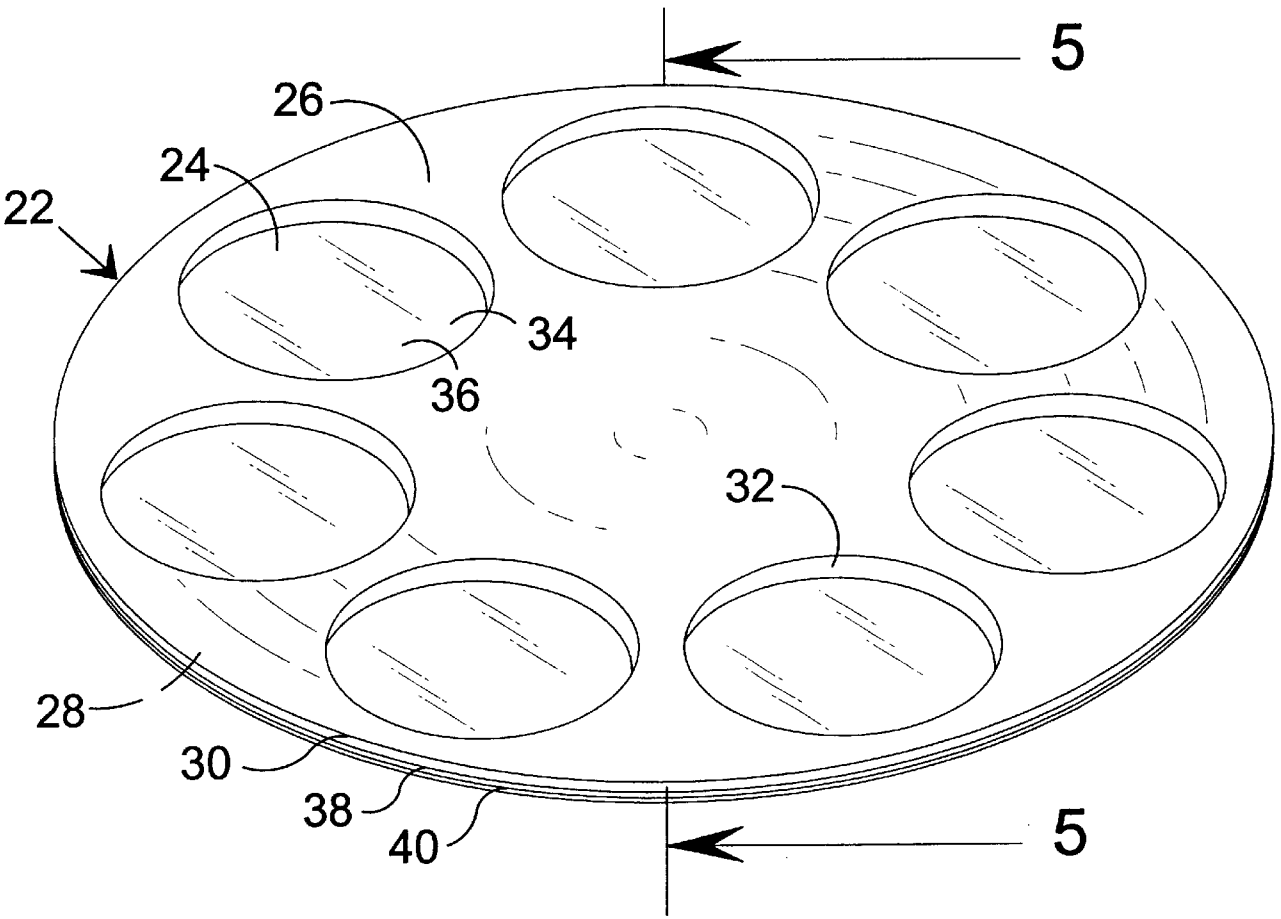
FIG. 2 is a perspective view of a single sided workpiece template.

FIG. 2 is a perspective view of the workpiece template of the present invention 10. Shown is the workpiece template having a main plate 22 having a plurality of spaced apart cavities 24 used to separate brittle workpieces during the lapping/polishing operation. The workpiece template 10 has a top surface 26 and a bottom surface 28 with the cavities passing therethrough. The workpiece template 10 also has a frictionless material 36 bonded to the bottom surface 28 of the workpiece template forming a frictionless base 34 for the workpiece cavities 24. Positioned on the opposing side of the frictionless material 34 is a peelably removable covering 40 engaging an adhesive layer 38 that is used to engage the rotating heads 20 of the lapping/polishing machine 12 during the lapping/polishing operation. As the wafers are rotated underneath the lapping/polishing heads 20 they will have a tendancy to rotate within the workpiece template cavity 24 which the frictionless material 36 will not inhibit.

Figure 3:
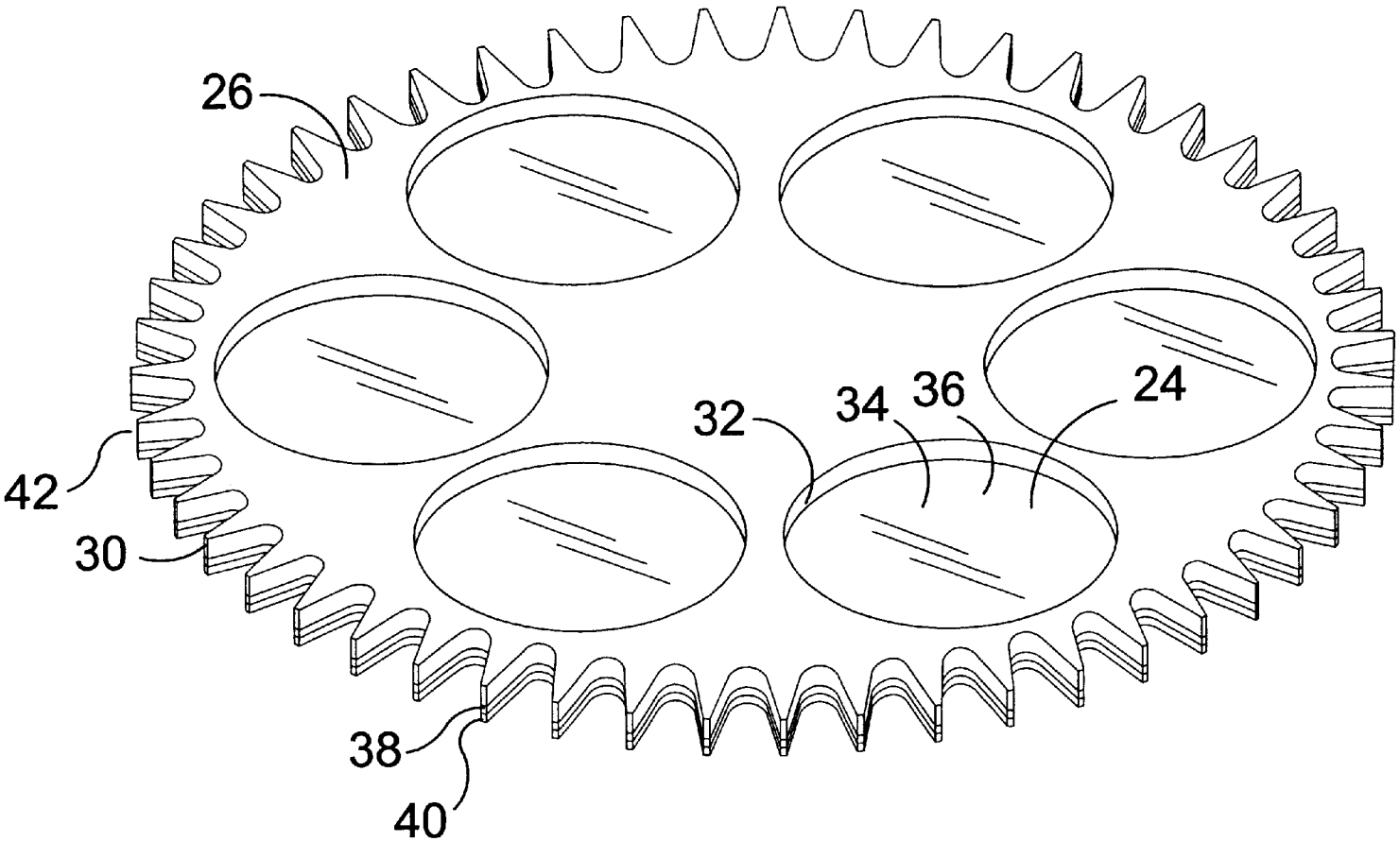
FIG. 3 is a perspective view of a single sided workpiece template having a notched gear-like periphery edge.

FIG. 3 is a perspective view of the workpiece template 10 of the present invention having an additional element in the form of a circumferentially notched gear-like periphery 42. The notches 42 are used in a particular type of lapping/polishing machine having a plurality of interiorly and exteriorly positioned posts for engaging the notched gear-like teeth 42 of the workpiece template 10 and holding it therebetween having the similar end result of lapping/polishing wafers positioned within the cavities 24 of the workpiece template 10. Also shown is the workpiece template 10 having a main plate 22 with a plurality of spaced apart cavities 24 for the positioning therein of wafers intended for lapping and/or polishing. The workpiece template 10 is comprised of a main plate 22 having a layer of frictionless material 36 bonded to the main plate 22 and forming the base of the workpiece cavities 34. The base of the cavities 34 being significantly frictionless will not inhibit the rotation of the wafers during the lapping/polishing operation.

Figure 4:
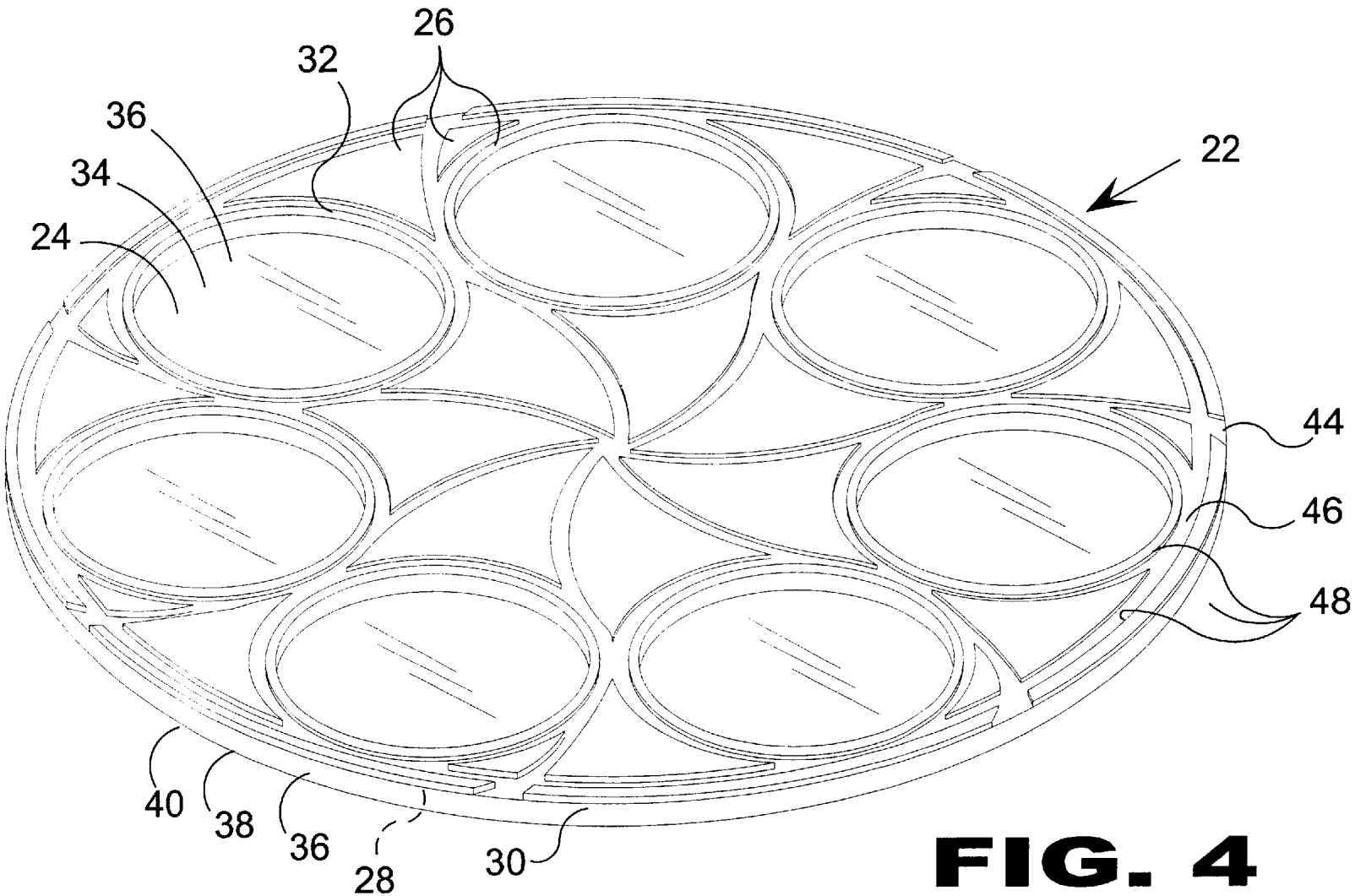
FIG. 4 is a perspective view of a single sided workpiece template having a plurality of spiraling channels.

FIG. 4 is a perspective view of the present invention having an additional element in the form of channels 44 positioned within the top surface 26 of the main plate 22 of the workpiece template. The channels 42 have a channel base 46 and channel walls 48 extending from the exterior wall 30 of the main plate 22 across the top surface 28 providing means for the lapping/polishing material 18 to move freely between the workpiece cavities 24. Also shown is the channeled workpiece template having a plurality of spaced apart cavities 24 passing therethrough that are used to hold wafers for the intended operation of lapping and/or polishing. The workpiece template 10 also has a frictionless material 36 bonded to the bottom surface 28 of the workpiece template forming a frictionless base 34 for the workpiece cavities 24. Positioned on the opposing side of the frictionless material is a peelably removable covering 40 engaging an adhesive layer 38 that is used to engage the rotating heads 20 of the lapping/polishing machine 12 during the lapping/polishing operation. As the wafers are rotated underneath the lapping/polishing heads 20 they will have a tendancy to rotate within the workpiece template cavities 24 which the frictionless material 36 will not inhibit. The channels 44 are positioned to engage the lapping/polishing planar worksurface 14 having an amount of lapping/polishing material 16 thereon. In the prior illustrations the lapping/polishing material 16 has a largely planar surface with the workpieces extending from the workpiece template cavities 24. As the wafers approach the thickness of the workpiece cavities 24 the fluid 16 between the workpiece template 10 and the lapping/polishing planar worksurface 14 diminishes causing the workpiece template 10 to burnish and/or the workpieces to ride out of the workpiece cavities 24. Upon a cross sectional inspection of the processed wafers the edges are thinner than the center of the wafer. This also influences the rotational speed of the lapping/polishing operation and the number of wafers that can be placed in a template. The present invention overcomes these shortcomings by providing channels 44 that spiral in the same direction as the rotating heads 20. Thereby causing the lapping/polishing material 16 into the channels 44 providing an abundance of lapping/polishing material 16 across the entire template surface 26.

Figure 5:
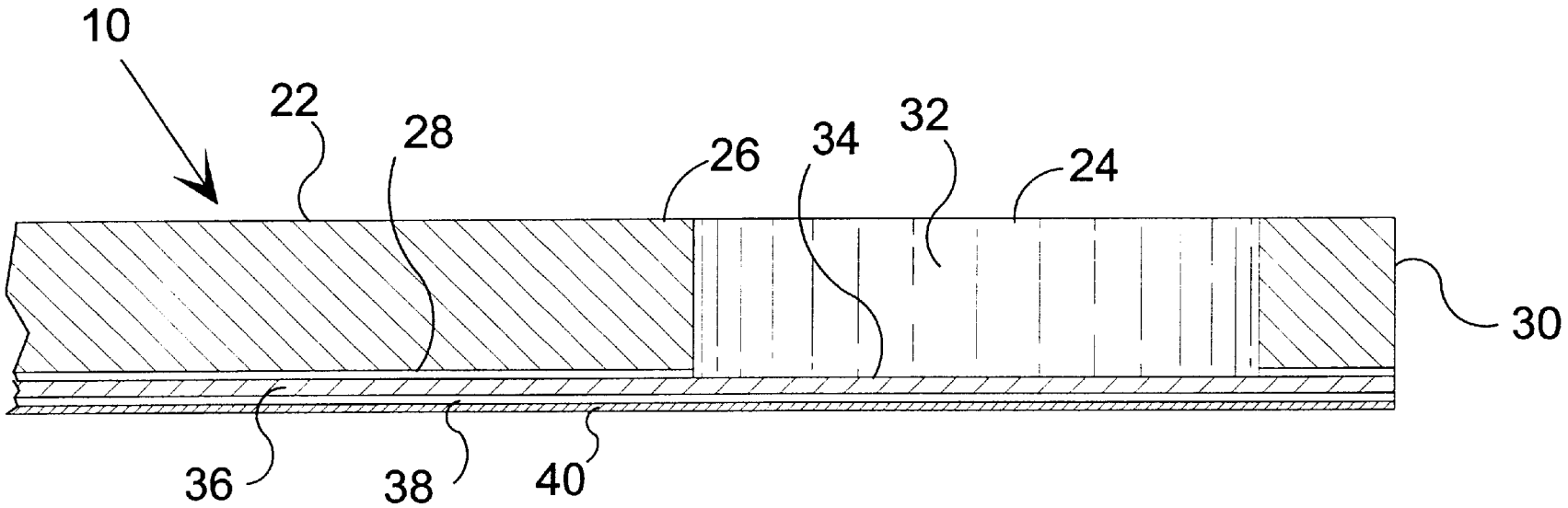
FIG. 5 is a cross sectional view of the workpiece template.

FIG. 5 is a cross sectional view of the workpiece template 10 of the present invention, taken from FIG. 2 as indicated. Shown is the workpiece template having a main plate 22 having a cavity 24 used to separate brittle workpieces during the lapping/polishing operation. The workpiece template 10 has a top surface 26 and a bottom surface 28 with the cavity 24 having a cavity wall 32 passing therethrough. The workpiece template 10 also has a frictionless material 36 bonded to the bottom surface 28 of the workpiece template by any means known within the art, such as adhesively. The frictionless material forms a frictionless cavity base 34 for the workpiece cavity 24. Positioned on the opposing side of the frictionless material 36 is a peelably removable covering 40 engaging an adhesive layer 38 that is used to engage the rotating heads 20 of the lapping/polishing machine 12 during the lapping/polishing operation. As the wafers are rotated underneath the lapping/polishing heads 20 they will have a tendancy to rotate within the workpiece template cavity 24 which the frictionless material 36 will not inhibit.

Figure 6:
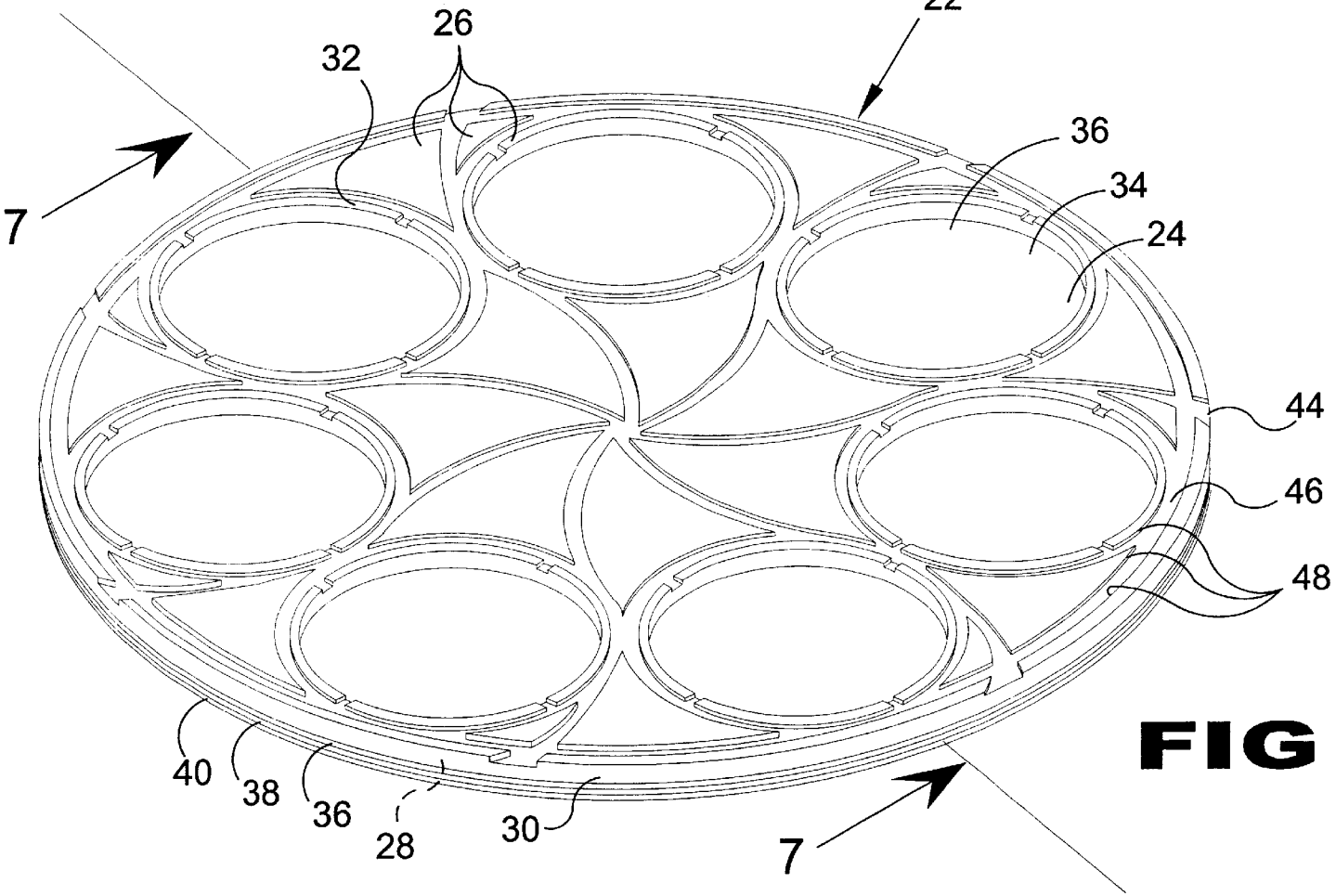
FIG. 6 is a perspective view of the present invention having channels.

FIG. 6 is a perspective view of the present invention wherein the spiraling channels 44 positioned within the top surface 26 of the main plate 22 of the workpiece template extend from the exterior wall 30 of the main plate 22 across the top surface 28 and through the workpiece template cavity walls 32 providing means for the lapping/polishing material 18 to move freely between and around the workpiece cavities 24 and workpiece cavity wall 32. The workpiece template 10 also has a frictionless material 36 bonded to the bottom surface 28 of the workpiece template forming a frictionless base 34 for the workpiece cavities 24. Positioned on the opposing side of the frictionless material is a peelably removable covering 40 engaging an adhesive layer 38 that is used to engage the rotating heads 20 of the lapping/polishing machine 12 during the lapping/polishing operation. As the wafers are rotated underneath the lapping/polishing heads 20 they will have a tendancy to rotate within the workpiece template cavities 24 which the frictionless material 36 will not inhibit. The channels 44 are positioned to engage the lapping/polishing planar worksurface 14 having an amount of lapping/polishing material 16 thereon.

Figure 7:
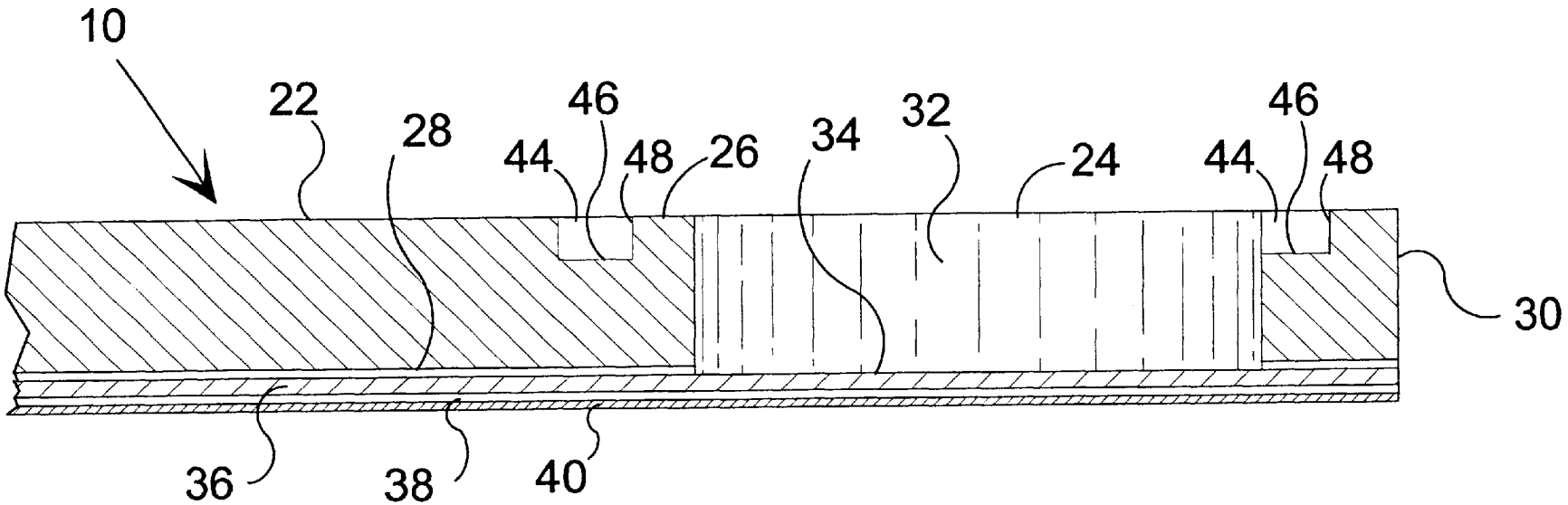
FIG. 7 is a cross sectional view of the channeled workpiece template.

FIG. 7 is a partial cross sectional view of the workpiece template 10 of the present invention, taken from FIG. 6 as indicated. Shown is the workpiece template having a main plate 22 having a cavity 24 used to separate brittle workpieces during the lapping/polishing operation. The workpiece template 10 has a top surface 26 and a bottom surface 28 with the cavity 24 having a cavity wall 32 passing therethrough. The top surface 26 of the main plate 22 has a channel 44 having a channel base 46 and channel wall 48 etched therein. The channel extends through the template cavity wall 32 whereby the abrasive material 18 will circulate freely around the wafers intended for lapping/polishing positioned within the workpiece cavity 24. Also shown is the workpiece template 10 having a frictionless material 36 bonded to the bottom surface 28 of the workpiece template by any means known within the art, such as adhesively. The frictionless material forms a frictionless cavity base 34 for the workpiece cavity 24. Positioned on the opposing side of the frictionless material 36 is a peelably removable covering 40 engaging an adhesive layer 38 that is used to engage the rotating heads 20 of the lapping/polishing machine 12 during the lapping/polishing operation.

Figure 8:
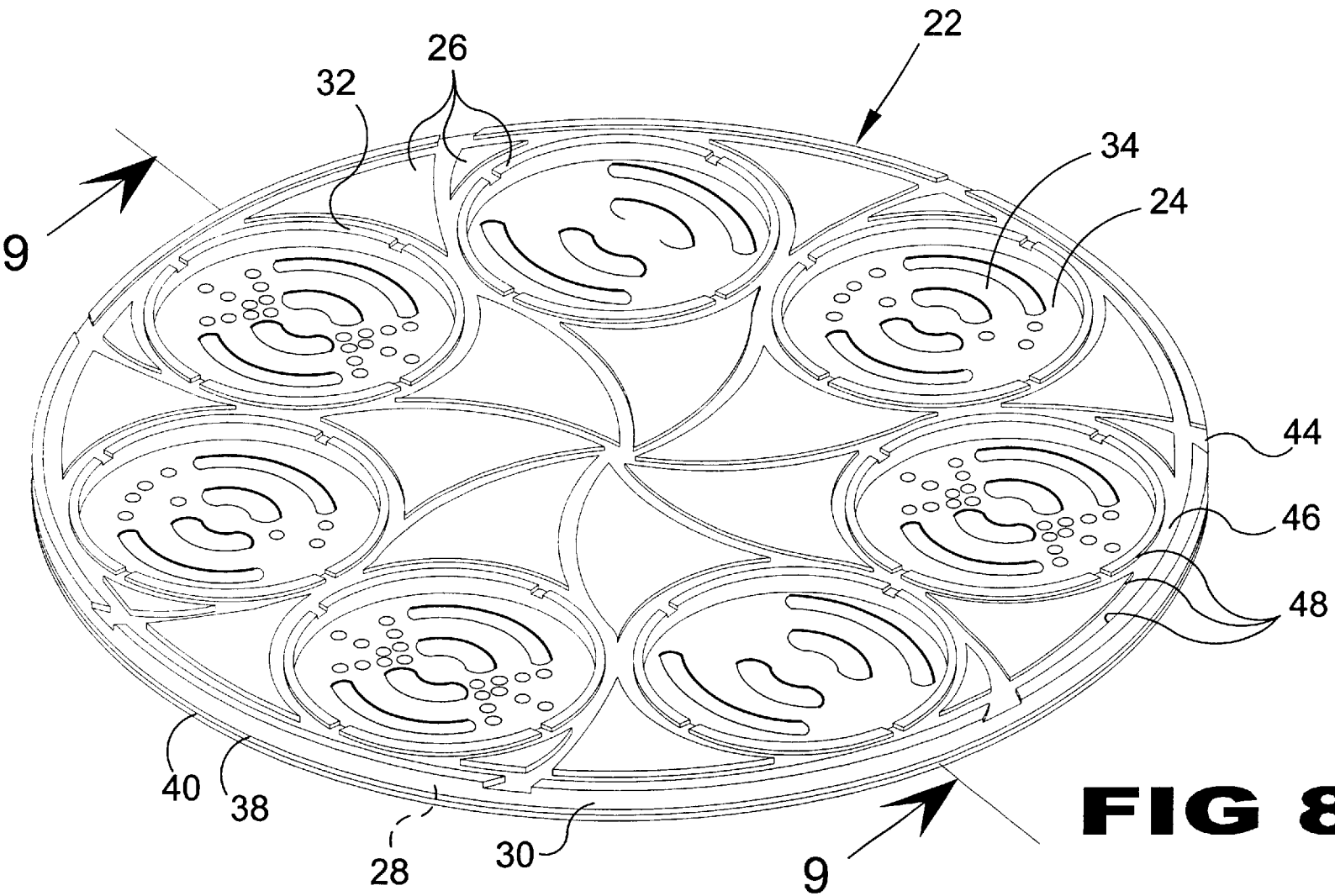
FIG. 8 is a perspective view of the workpiece template having cavity channels.
Figure 9:
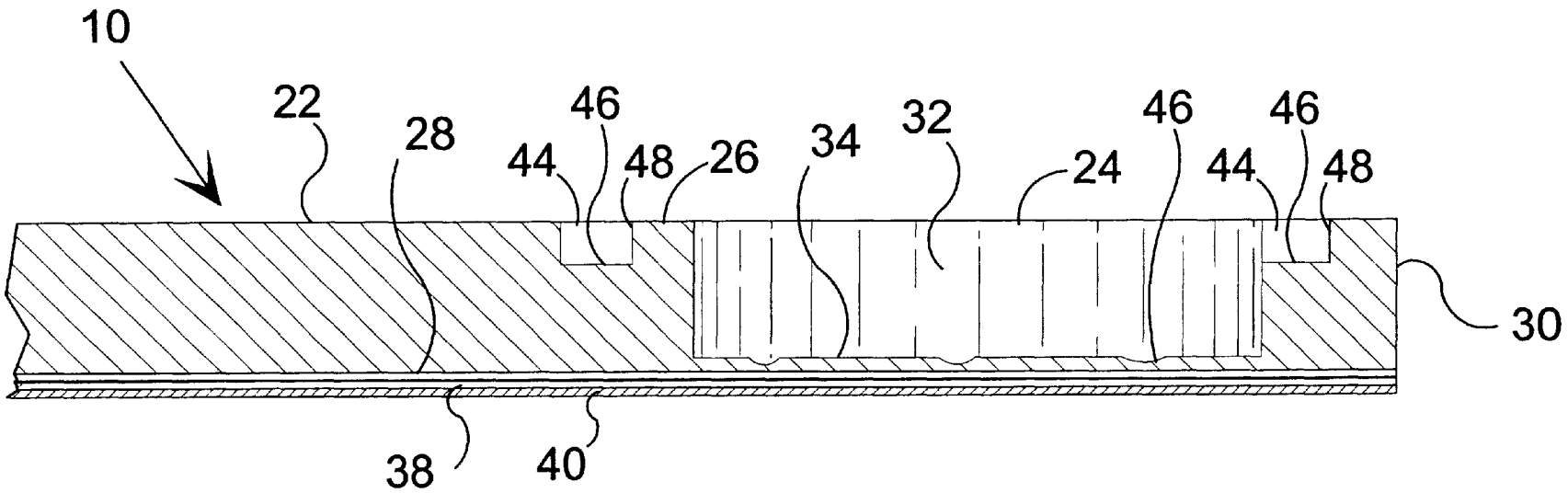
FIG. 9 is a cross sectional view of the channeled workpiece cavities.

FIG. 8 is a perspective view of the present invention wherein the spiraling channels 44 positioned within the top surface 26 of the main plate 22 of the workpiece template extend from the exterior wall 30 of the main plate 22 across the top surface 28 and through the workpiece template cavity walls 32 providing means for the lapping/polishing material 18 to move freely between and around the workpiece cavities 24 and workpiece cavity wall 32. Also shown are channels 44 etched into the cavity base 34 of main plate 22. Positioned on the bottom surface 28 is a peelably removable covering 40 engaging an adhesive layer 38 that is used to engage the rotating heads 20 of the lapping/polishing machine 12 during the lapping/polishing operation. FIG. 9 is a partial cross sectional view of the workpiece template 10 of the present invention, taken from FIG. 8 as indicated. Shown is the workpiece template having a main plate 22 having a cavity 24 used to separate brittle workpieces during the lapping/polishing operation that extends partially through main plate 22. The workpiece template 10 has a top surface 26 and a bottom surface 28 with the cavity 24 having a cavity wall 32. The top surface 26 of the main plate 22 has a channel 44 having a channel base 46 and channel wall 48 etched therein. The channel extends through the template cavity wall 32 whereby the abrasive material 18 will circulate freely around the wafers intended for lapping/polishing positioned within the workpiece cavity 24. Positioned on the bottom surface of main plate 22 is a peelably removable covering 40 engaging an adhesive layer 38 that is used to engage the rotating heads 20 of the lapping/polishing machine 12 during the lapping/polishing operation.

Figure 10:
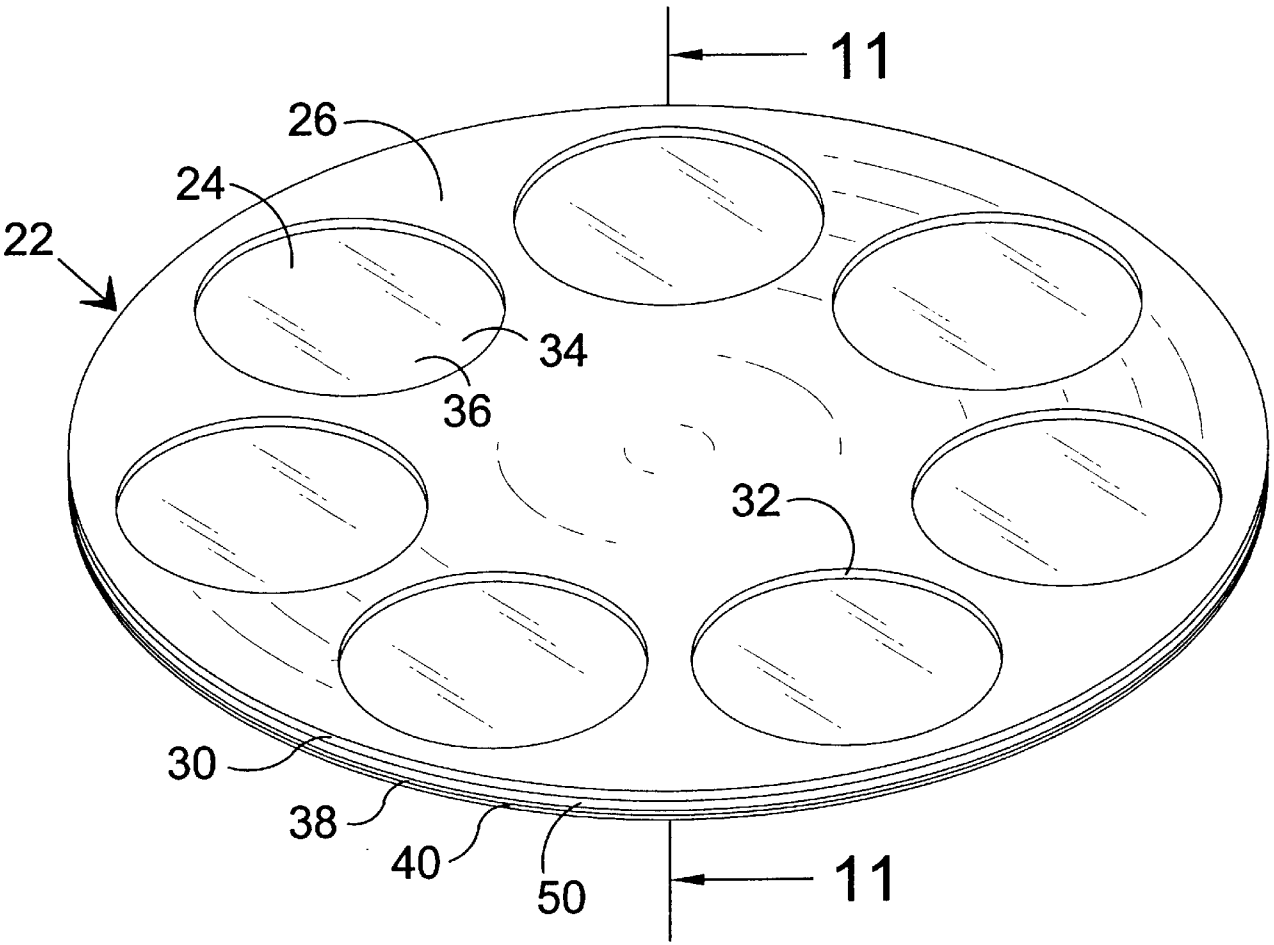
FIG. 10 is a perspective view of the workpiece template of the present invention having a backing plate.

FIG. 10 is a perspective view of the workpiece template of the present invention 10. Shown is the workpiece template having a main plate 22 and a backing plate 50. The main plate 22 has a plurality of spaced apart cavities 24 used to separate brittle workpieces during the lapping/polishing operation. The workpiece template 10 has a top surface 26 and a bottom surface 28 with the cavities passing therethrough with the backing plate top surface 52 forming the cavity base 34. Positioned on the backing plate bottom surface 54 is a peelably removable covering 40 engaging an adhesive layer 38 that is used to engage the rotating heads 20 of the lapping/polishing machine 12 during the lapping/polishing operation.

Figure 11:
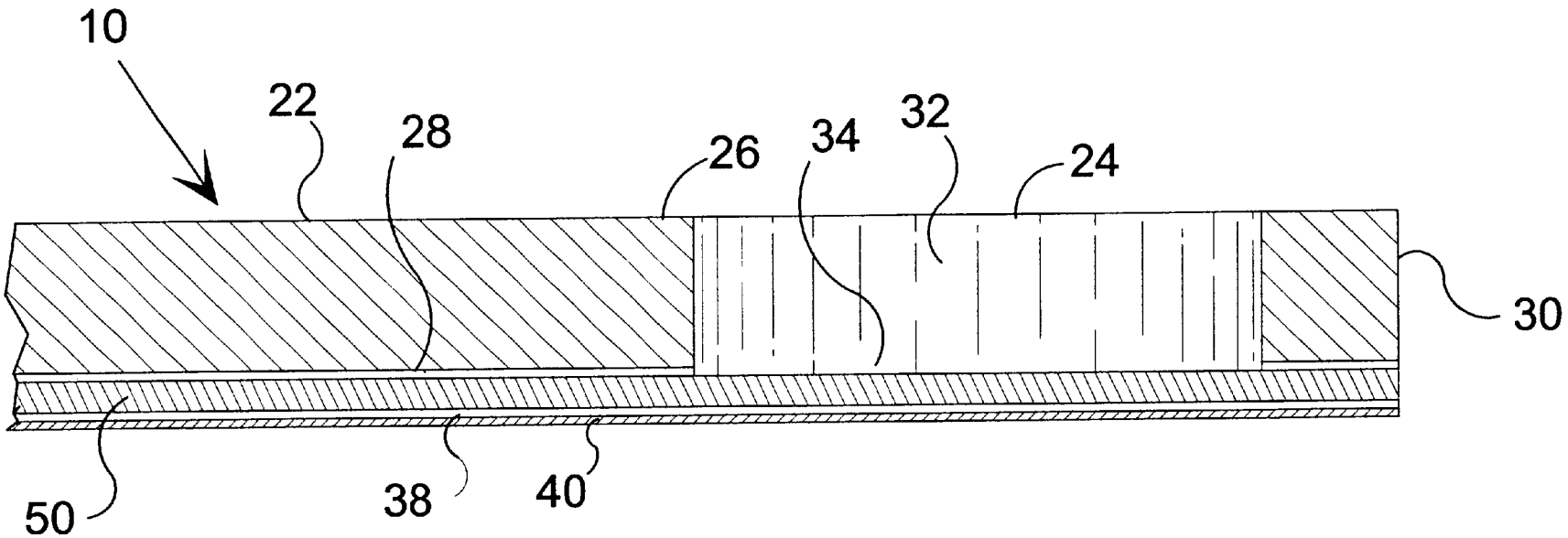
FIG. 11 is a cross sectional view of the workpiece template having a backing plate.

FIG. 11 is a cross sectional view of the workpiece template 10 of the present invention, taken from FIG. 10 as indicated. Shown is the workpiece template having a main plate 22 having a cavity 24 used to separate brittle workpieces during the lapping/polishing operation. The workpiece template 10 has a top surface 26 and a bottom surface 28 with the cavity 24 having a cavity wall 32 passing therethrough. Engaging the bottom surface 28 of the main plate 22 is the top surface 52 of backing plate 50. Positioned on the bottom surface 54 of backing plate 50 is a peelably removable covering 40 engaging an adhesive layer 38 that is used to engage the rotating heads 20 of the lapping/polishing machine 12 during the lapping/polishing operation.

Figure 12:
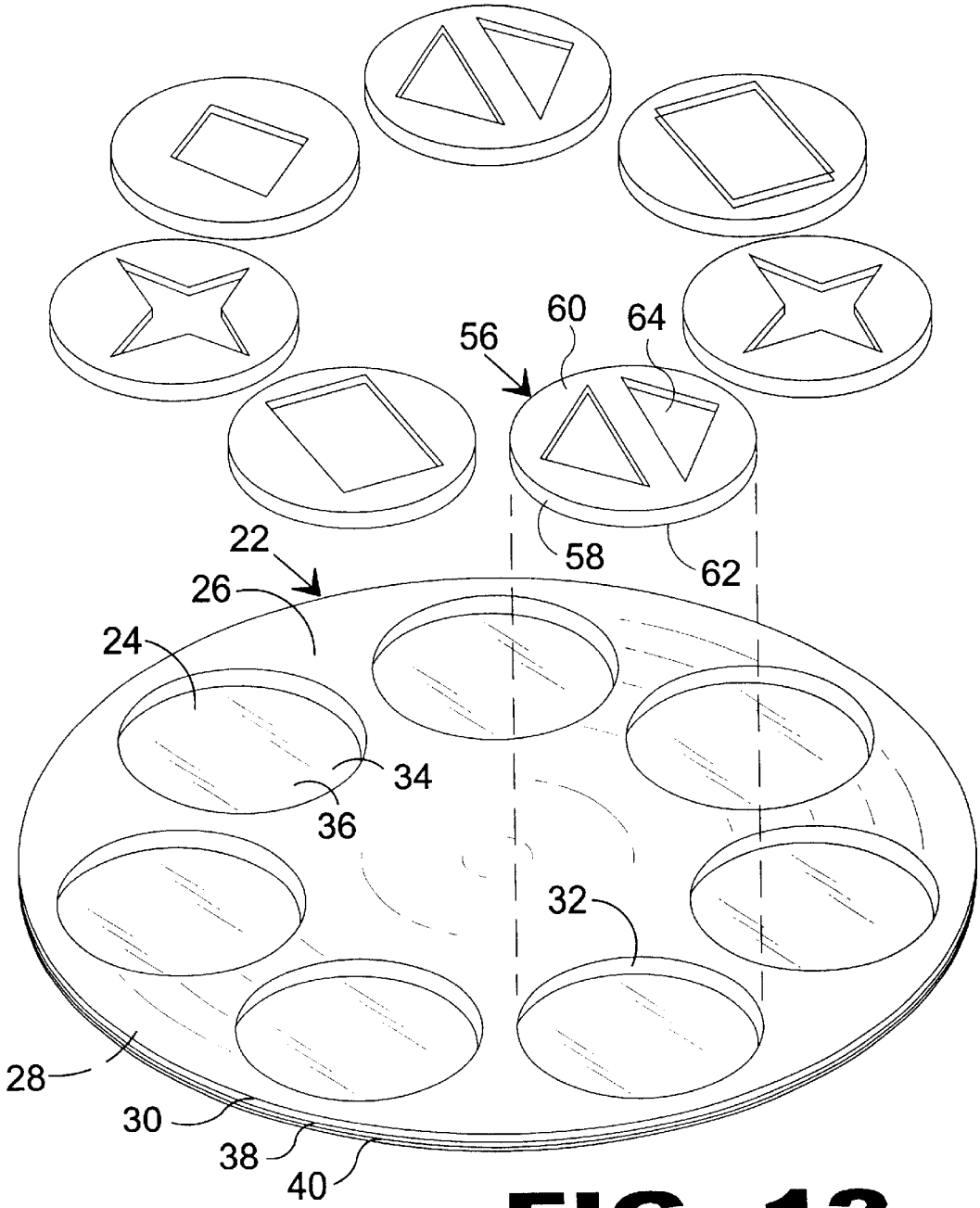
FIG. 12 is a perspective view of the template cavity unit.

FIG. 12 is a perspective view of an additional element of the present invention. Shown is the template cavity unit 56 having a diameter substantially equal to the main plate cavity 24 whereby non-standard workpieces having a template cavity unit 56 can be inserted into one or more of the main plate cavities 24 without having to create a specific template for the non-standard shapes. The template cavity unit top surface 60 coincides with the top surface of the main plate 26.

Figure 13:
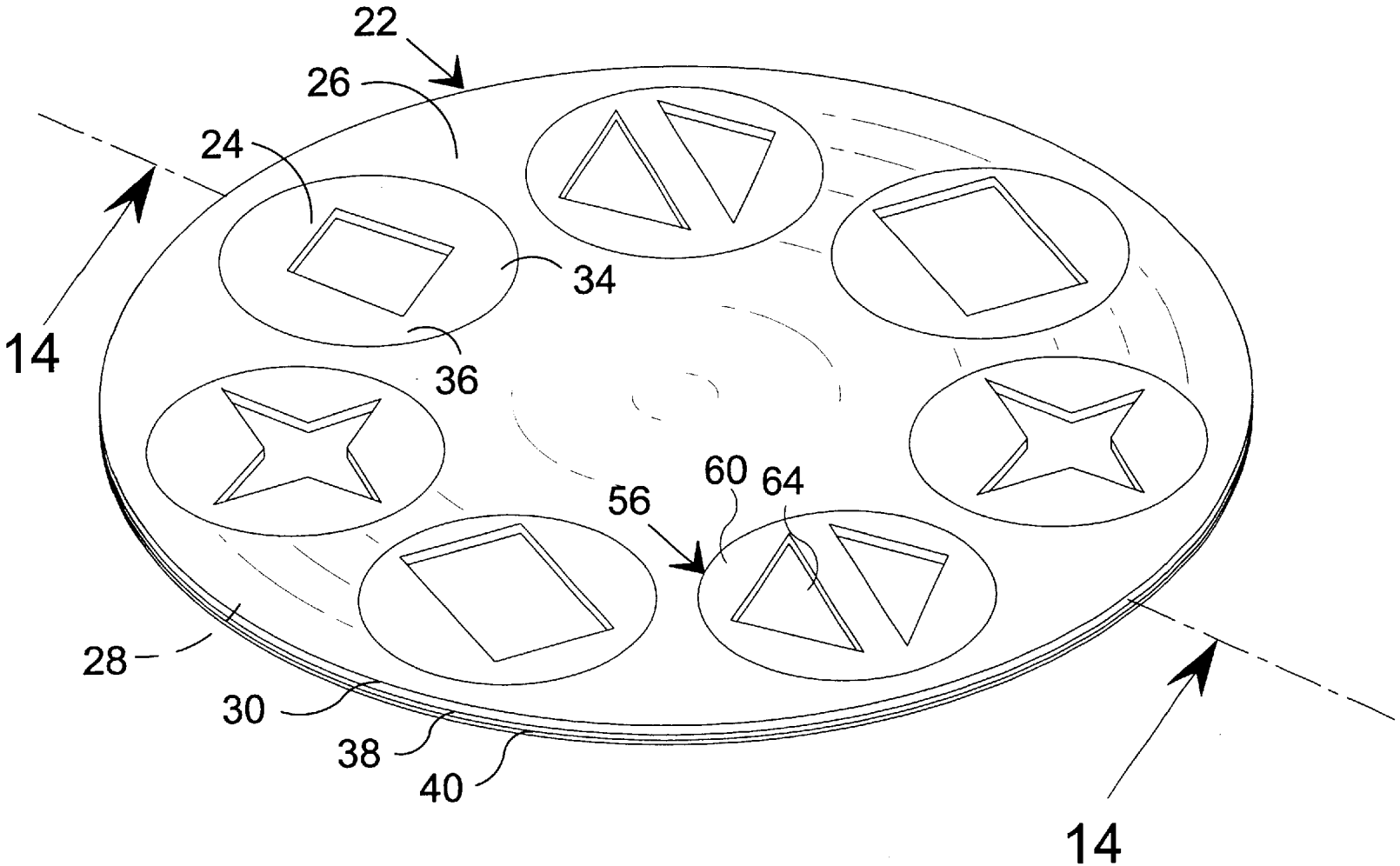
FIG. 13 is a perspective view of the template cavity unit installed in the workpiece template cavity.

FIG. 13 is a perspective view of the template cavity 56 positioned within the main plate cavity 24. The template cavity unit exterior wall 58 engages the workpiece cavity wall 32 to prevent chattering of the unit 58. The template cavity unit top surface 60 is in planar alignment with the top surface of main plate 26. The template cavity unit bottom surface 62 engages the workpiece template cavity base 34. The non-standard shape of the template cavity unit cavity 64 can be of any shape or any number of cavities that can be etched in the top surface of the template cavity unit 56.

Figure 14:
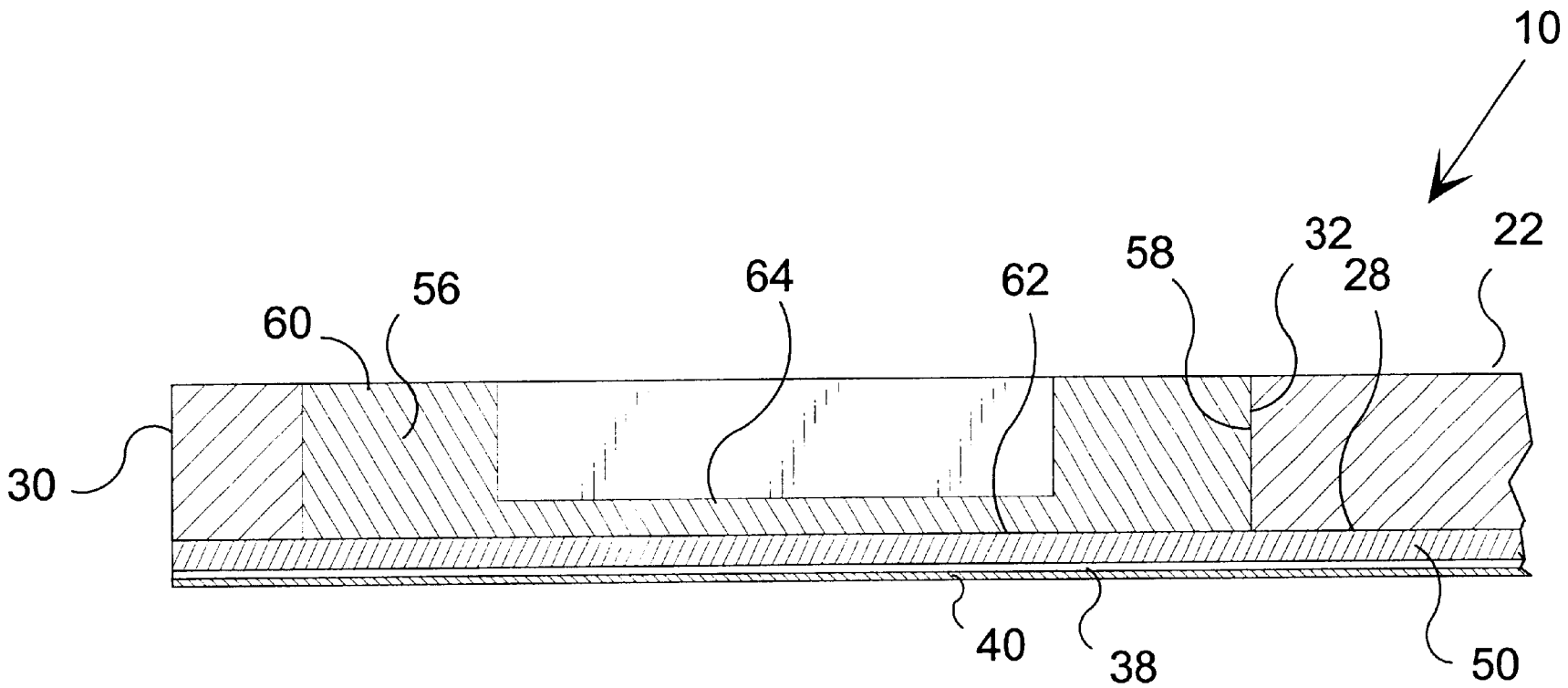
FIG. 14 is a cross sectional view of the installed template cavity unit.

FIG. 14 is a cross sectional view of the template cavity unit positioned within the main plate cavity 24 of main plate 22. The template cavity unit cavity 64 is contained within the template cavity unit. The template cavity unit bottom surface 62 engages the backing plate top surface 52. The diameter of the template cavity unit 56 is substantially equivalent to the diameter of the main plate cavity 24 whereby the template cavity exterior wall 58 engages the workpiece template cavity wall 32. In addition, once seated within the main plate cavity 24 the top surface of the template cavity unit 60 is in planar alignment with the top surface of the main plate 26. Also shown is the workpiece holder 10 having a backing plate 50. The backing plate 50 has an adhesive layer 38 with a protective element 40 whereby the workpiece holder 10 can be attached to the rotating heads 20 of the lapping/polishing machine 12.

Figure 15:
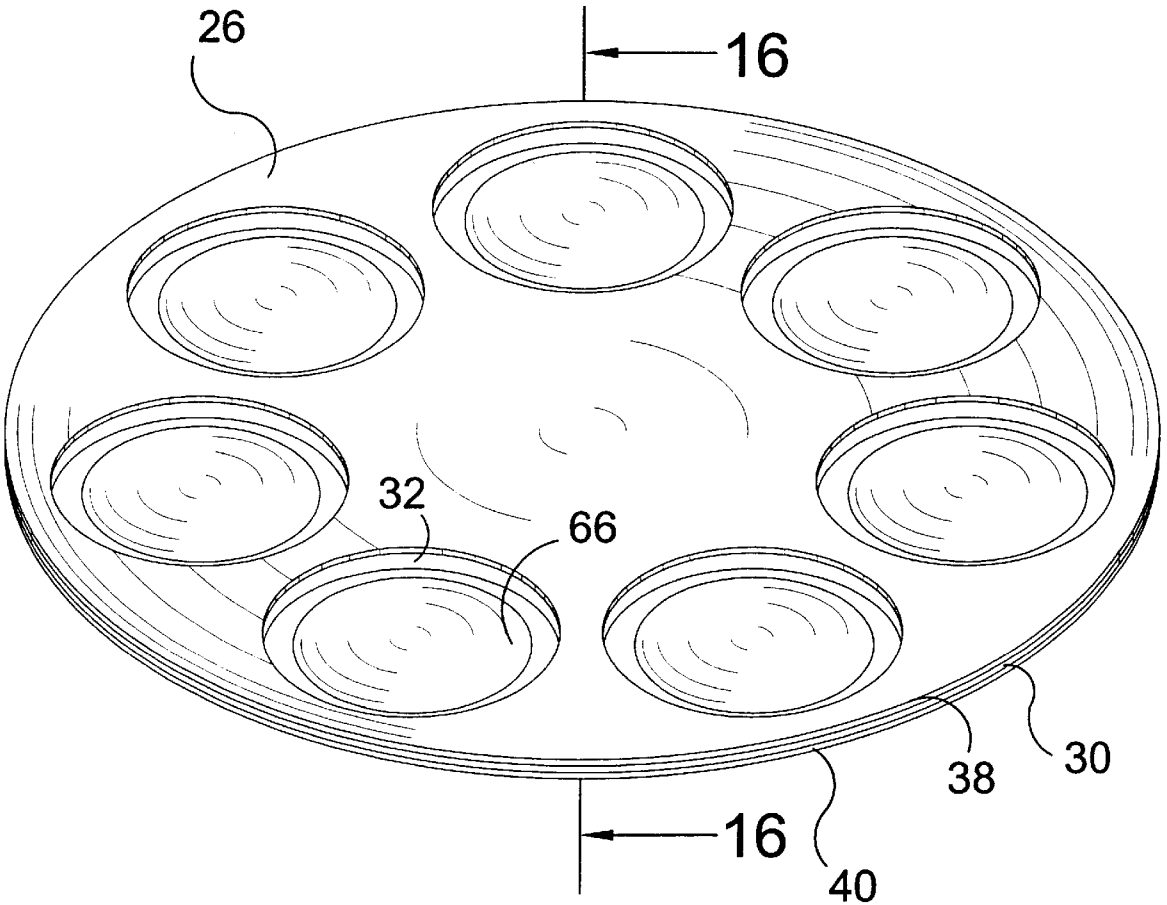
FIG. 15 is a perspective view of the workpiece template having a shim positioned within the template cavity.

FIG. 15 is a perspective view of the workpiece template of the present invention 10. Shown is the workpiece template having a main plate 22 and a backing plate 50. The main plate 22 has a plurality of spaced apart cavities 24 used to separate brittle workpieces during the lapping/polishing operation having a shim 56 positioned at the base of cavity 24. The workpiece template 10 has a top surface 26 and a bottom surface 28 with the cavities passing therethrough with the backing plate top surface 52 forming the cavity base 34 with shim 56 fixed thereto. Positioned on the backing plate bottom surface 54 is a peelably removable covering 40 engaging an adhesive layer 38 that is used to engage the rotating heads 20 of the lapping/polishing machine 12 during the lapping/polishing operation.

Figure 16:
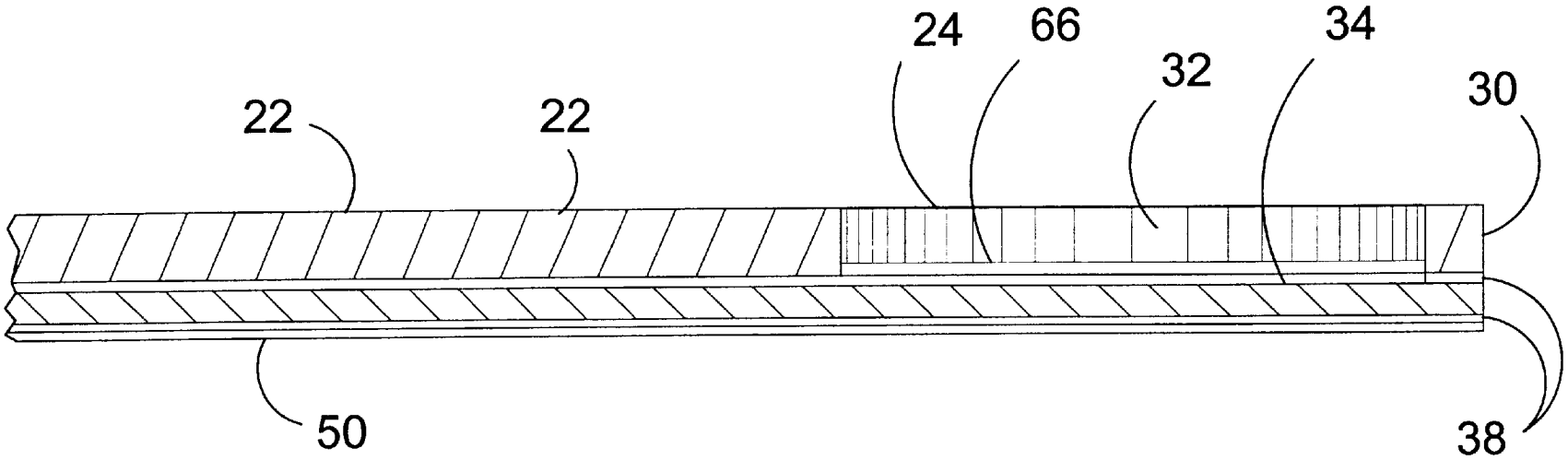
FIG. 16 is a cross sectional view of the workpiece template having a cavity shim.

FIG. 16 is a cross sectional view of the workpiece template 10 of the present invention, taken from FIG. 15 as indicated. Shown is the workpiece template having a main plate 22 having a cavity 24 used to separate brittle workpieces during the lapping/polishing operation. The workpiece template 10 has a top surface 26 and a bottom surface 28 with the cavity 24 having a cavity wall 32 passing therethrough. Engaging the bottom surface 28 of the main plate 22 is the top surface 52 of backing plate 50. Positioned on the bottom surface 54 of backing plate 50 is a peelably removable covering 40 engaging an adhesive layer 38 that is used to engage the rotating heads 20 of the lapping/polishing machine 12 during the lapping/polishing operation.

From the above description it can be seen that the method and apparatus for lapping and polishing silicon wafers of the present invention is able to overcome the shortcomings of prior art devices by providing a method and apparatus for lapping and polishing silicon wafers which is able to be used repeatedly to produce a plurality of silicon wafers.

The apparatus for lapping and polishing silicon wafers includes templates having a main disk substantially comprised of fiberglass-epoxy laminates and including cavities extending therein. A backing material adhesively affixed to the main disk and a layer formed of Mylar or other suitable frictionless material is affixed to the backing material.

A plurality of shims manufactured from a suitable material such as polyurethane may be affixed to the base of the cavities for adjusting the depth of the cavity. The shims are removably inserted into each of the plurality of cavities within the template. The plurality of shims are of various thickness=that can be removably inserted into each of the plurality of cavities within the template whereby the template can be used to produce wafers of various and/or calculated thickness=.

The method and apparatus for lapping and polishing silicon wafers is also able to reduce tapering of the wafer. Furthermore, the method and apparatus for lapping and polishing silicon wafers of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by letters Patent is set forth in the appended claims:

1. A workpiece template for forming wafers of varying thickness, =said template comprising:

a) a main plate having a top side and a bottom side and at least one cavity extending therethrough;

b) an adhesive lawyer fixedly positioned to the bottom side of said main plate;

c) a peelably removable covering for said adhesive layer; and d) a frictionless material positioned within a base of the at least one cavity.

2. The template as recited in claim 1, wherein the frictionless material is color coded representative of the thickness of the at least one cavity.

3. The template as recited in claim 1, having a plurality of spaced apart cavities passing through the main plate for separating workpieces during lapping and polishing operations.

4. The template as recited in claim 1, having a shim fixedly positioned within at least one of the plurality of template cavities.

5. The template as recited in claim 1, having a selectively positionable/replacable shim in the plurality of template cavities.

6. The template as recited in claim 1, wherein the frictionless material forms the cavity base.

7. A workpiece template for forming wafers of varying thickness, =said template comprising:

a) a main plate having a top side and a bottom side and at least one cavity extending therethrough;

b) a main plate having an exterior wall with notches forming gear-like teeth;

c) an adhesive layer fixedly positioned to the bottom side of said main plate;

d) a peelably removable covering for said adhesive layer; and e) a frictionless material positioned within a base of the at least one cavity.

8. The template as recited in claim 7, wherein the frictionless material is color coded representative of the thickness of the at least one cavity.

9. The template as recited in claim 7, having a plurality of spaced apart cavities passing through the main plate for separating workpieces during lapping and polishing operations.

10. The template as recited in claim 7, having a shim fixedly positioned within at least one of the plurality of template cavities.

11. The template as recited in claim 7, having a selectively positionable/replacable shim in the plurality of template cavities.

12. The template as recited in claim 7, wherein the frictionless material forms the cavity base.

13. A workpiece template for forming wafers of varying thickness, =said template comprising:

a) a main plate having a top side and a bottom side and at least one cavity extending therethrough;

b) A main plate having a plurality of grooves etched into the top side of the main plate;

c) a backing plate having a top side forming the template cavity base;

d) an adhesive layer fixedly positioned to the bottom side of said backing plate; and e) a peelably removable covering for said adhesive layer.

14. A workpiece template for forming wafers of varying thickness, =said template comprising:

a) a main plate having a top side and a bottom side and at least one cavity extending therethrough;

b) an adhesive layer fixedly positioned to the bottom side of said main plate;

c) a peelably removable covering for said adhesive layer; and d) a frictionless material positioned within a base of the at least one cavity.

15. The template as recited in claim 14, wherein the frictionless material is color coded representative of the thickness of the at least one cavity.

16. The template as recited in claim 14, having a plurality of spaced apart cavities passing through the main plate for separating workpieces during lapping and polishing operations.

17. The template as recited in claim 14, having a shim fixedly positioned within at least one of the plurality of template cavities.

18. The template as recited in claim 14, having a selectively positionable/replacable shim in the plurality of template cavities.

19. The template as recited in claim 14, wherein the frictionless material forms the cavity base.

* * * * *